US006743044B2

(12) United States Patent
Musolf et al.

(10) Patent No.: US 6,743,044 B2
(45) Date of Patent: Jun. 1, 2004

(54) CROSS-CONNECT JUMPER ASSEMBLY HAVING TRACER LAMP

(75) Inventors: Bruce Musolf, Eagan, MN (US); Thomas Good, Mound, MN (US); Richard T. Demulling, Maplewood, MN (US); Dennis Burroughs, Savage, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 10/219,809

(22) Filed: Aug. 14, 2002

(65) Prior Publication Data

US 2004/0033716 A1 Feb. 19, 2004

(51) Int. Cl.[7] ..... H01R 3/00

(52) U.S. Cl. ..... 439/490; 439/488; 439/910; 439/668

(58) Field of Search ..... 439/488, 910, 439/668

(56) References Cited

U.S. PATENT DOCUMENTS 3,859,646 A * 1/1975 Schwellenbach ..... 340/664
4,600,810 A * 7/1986 Feldman et al. ..... 379/21
4,653,848 A 3/1987 Kloots
4,707,073 A 11/1987 Kocher
4,749,968 A 6/1988 Burroughs
4,887,190 A 12/1989 Sadamune et al.
4,969,834 A * 11/1990 Johnson ..... 439/141
4,978,194 A 12/1990 Allen et al.
5,193,087 A * 3/1993 Lichtash et al. ..... 370/360
5,228,109 A 7/1993 Fujii et al.
5,305,405 A 4/1994 Emmons et al.
5,393,249 A * 2/1995 Morgenstern et al. ..... 439/668
5,554,049 A * 9/1996 Reynolds ..... 439/490
5,913,701 A 6/1999 Olson et al.
5,964,616 A * 10/1999 Eisenbraun ..... 439/490
6,116,961 A 9/2000 Henneberger et al.
6,290,533 B1 * 9/2001 Major ..... 439/490
6,361,357 B1 * 3/2002 Stillwell et al. ..... 439/490
6,422,902 B1 * 7/2002 Ogren et al. ..... 439/668
6,431,906 B1 * 8/2002 Belopolsky ..... 439/490

* cited by examiner

*Primary Examiner*—Truc Nguyen
(74) *Attorney, Agent, or Firm*—Merchant & Gould P.C.

(57) ABSTRACT

A jumper assembly for a DSX system is disclosed herein. The jumper assembly includes a messenger wire for electrically connecting tracer lamp circuits corresponding to two cross-connected DSX modules. The jumper assembly also includes tracer lamp devices carried with the messenger wire.

34 Claims, 14 Drawing Sheets

CROSS-CONNECT JUMPER ASSEMBLY HAVING TRACER LAMP

FIELD OF THE INVENTION

The present invention relates generally to digital cross-connect equipment. More particularly, the present invention relates to cross-connect switching systems having tracer lamp circuits.

BACKGROUND OF THE INVENTION

In the telecommunications industry, the use of switching jacks to perform digital cross-connect (DSX) and monitoring functions is well known. The jacks may be mounted to replaceable cards or modules, which in turn may be mounted in a chassis, and multiple chassis may be mounted together in an equipment rack. Modules for use in co-axial environments are described in U.S. Pat. No. 5,913,701, which is incorporated herein by reference. Modules for use in twisted pair applications are described in U.S. Pat. No. 6,116,961. Cross-connect modules are also used with fiber optic communications systems.

FIG. 1 shows a prior art cross-connect arrangement of the type used for co-axial applications. The depicted arrangement includes two jack modules 20, 22. The jack modules 20, 22 may be mounted in separate chassis that are in turn mounted on separate racks. Each jack module 20, 22 is cabled to a separate network element (i.e., piece of telecommunications equipment). For example, jack module 20 is connected to equipment 24 by cables 26, and jack module 22 is connected to equipment 28 by cables 30. The pieces of equipment 24 and 28 are interconnected by cross-connect jumpers 32 (e.g., cables) placed between the two jack modules 20 and 22. Each jack module 20, 22 includes IN and OUT ports 34 and 36 for direct access to the equipment's input and output signals. Each module 20, 22 also includes X-IN and X-OUT ports 35, 37 for providing direct access to the cross-connect input and cross-connect output signals. Ports 34–37 provide a means to temporarily break the connection between the pieces of equipment 24 and 28 that are cross-connected together, and to allow access to the signals for test and patching operations. The jack modules 20, 22 also include monitor ports 38 for non-intrusive access to the input and output signals of each piece of telecommunications equipment 24, 28.

A typical telecommunications central office includes many jack modules and a large number of bundled cables interconnecting the modules. Consequently, absent indicators, it is difficult to quickly determine which two jack modules are cross-connected together. To assist in this function, the jack modules 20, 22 include indicator lights 40 wired to power 42 and ground 44. Switches 46 are positioned between the indicator lights 40 and ground 44. The indicator lights 40 are also electrically connected to pin jacks 48 located at the rear of the jack modules 20, 22. The pin jacks 48 provide connection locations for allowing the tracer lamp circuits corresponding to each of the modules 20, 22 to be interconnected by a messenger wire 50. The messenger wire 50 is typically bundled with the jumpers 32 to form a cross-connect jumper assembly. When either switch 46 is closed, the indicator lamps 40 corresponding to both of the jack modules 20, 22 are connected to ground and thereby illuminated. Thus, by closing one of the switches 46, the two jack modules 20, 22 that are cross-connected can be easily identified by merely locating the illuminated tracer lamps.

A problem with tracer lamp configurations as described above is that they are only visible from the front ends of the jack modules. Thus, a technician at the rear of the modules is required to walk around to the front to view the tracer lamps.

SUMMARY

The present disclosure describes representative embodiments that relate generally to DSX jumper assemblies having integral tracer lamps. The present disclosure also describes digital cross-connect LED circuitry that illuminates regardless of the direction of current travel. It will be appreciated that the various inventive aspects disclosed herein can be used together or separately from one another. It will further be appreciated that the disclosed examples are merely illustrative, and that variations can be made with respect to the depicted examples without departing from the broad scope of the inventive concepts.

BRIEF DESCRIPTION OF THE DRAWINGS

The accompanying drawings, which are incorporated in and constitute a part of the specification, illustrate various embodiments that are examples of how certain inventions can be put into practice. A brief description of the drawings is as follows.

DETAILED DESCRIPTION

Figure 1:
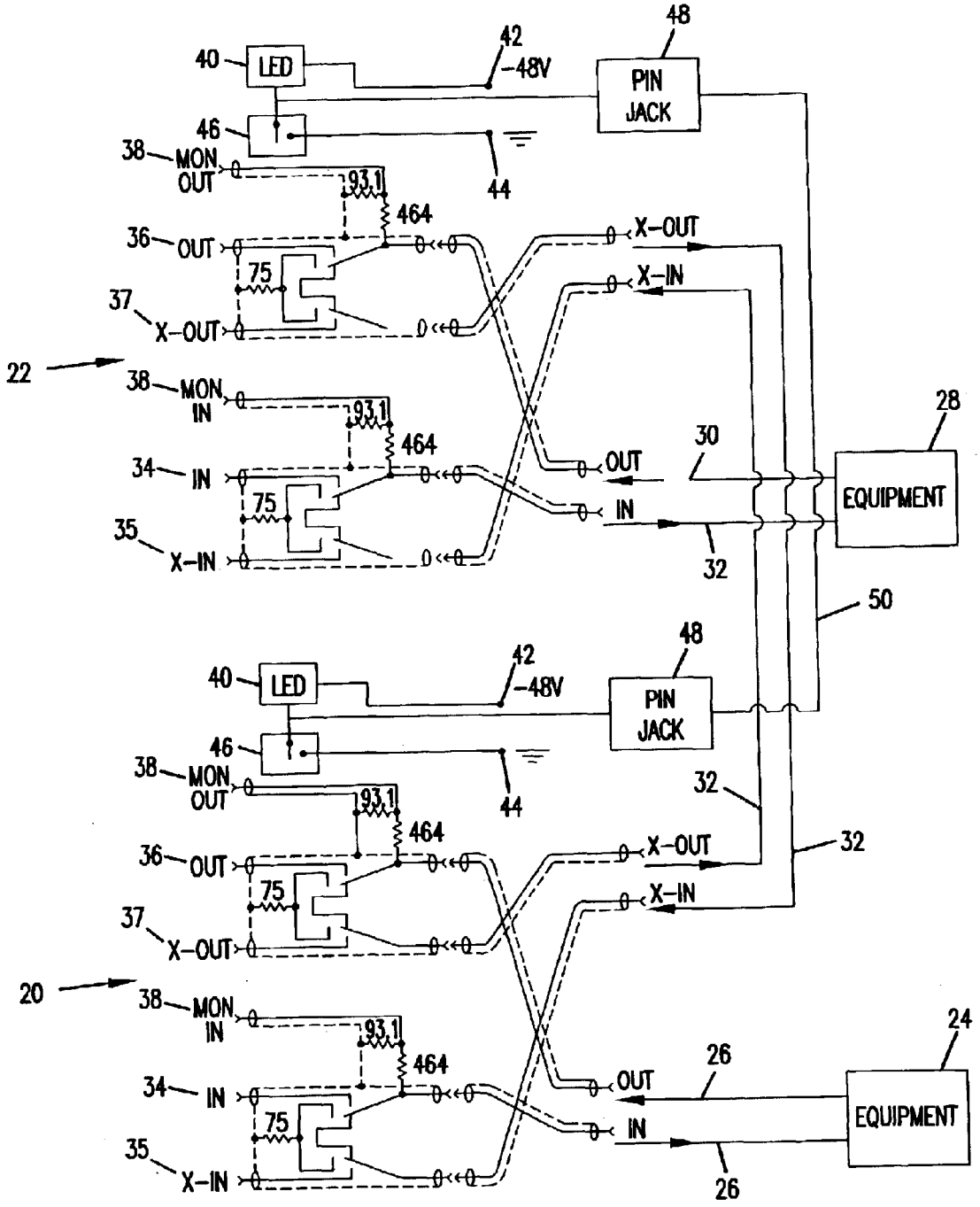
FIG. 1 PRIOR ART
FIG. 1 illustrates a prior art DSX system.
Figure 2:
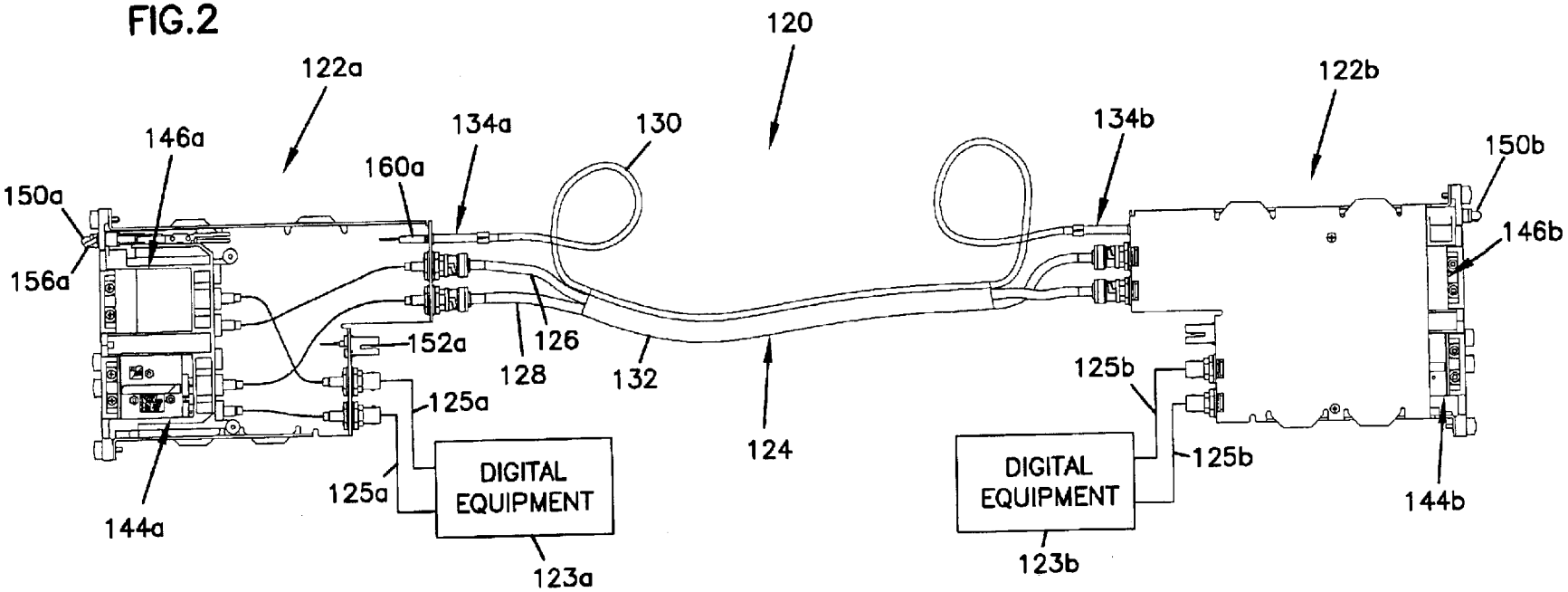
FIG. 2 illustrates a DSX system including a jumper assembly that is an example of how certain inventive aspects in accordance with the principles of the present invention may be practiced, the jumper assembly includes a messenger wire with integral tracer lamps.

FIG. 2 illustrates a digital cross-connect (DSX) system 120 that is an example of how certain inventive aspects in accordance with the principles of the present disclosure can be practiced. The DSX system 120 includes DSX modules 122*a*, 122*b* electrically connected to pieces of telecommunications equipment 123*a*, 123*b* by cables 125*a*, 125*b* (e.g., co-axial cables). The pieces of telecommunications equipment 123*a*, 123*b* are electrically connected to one another by a jumper assembly 124 that provides a cross-connection between the DSX modules 122*a*, 122*b*. The DSX modules 122*a*, 122*b* include tracer lamps (e.g., LED's 150*a*, 150*b*) that are visible from front ends of the modules 122*a*, 122*b*. The jumper assembly 124 includes tracer lamp assemblies 134*a*, 134*b* that are visible from rear ends of the modules 122*a*, 122*b*.

Figure 3:
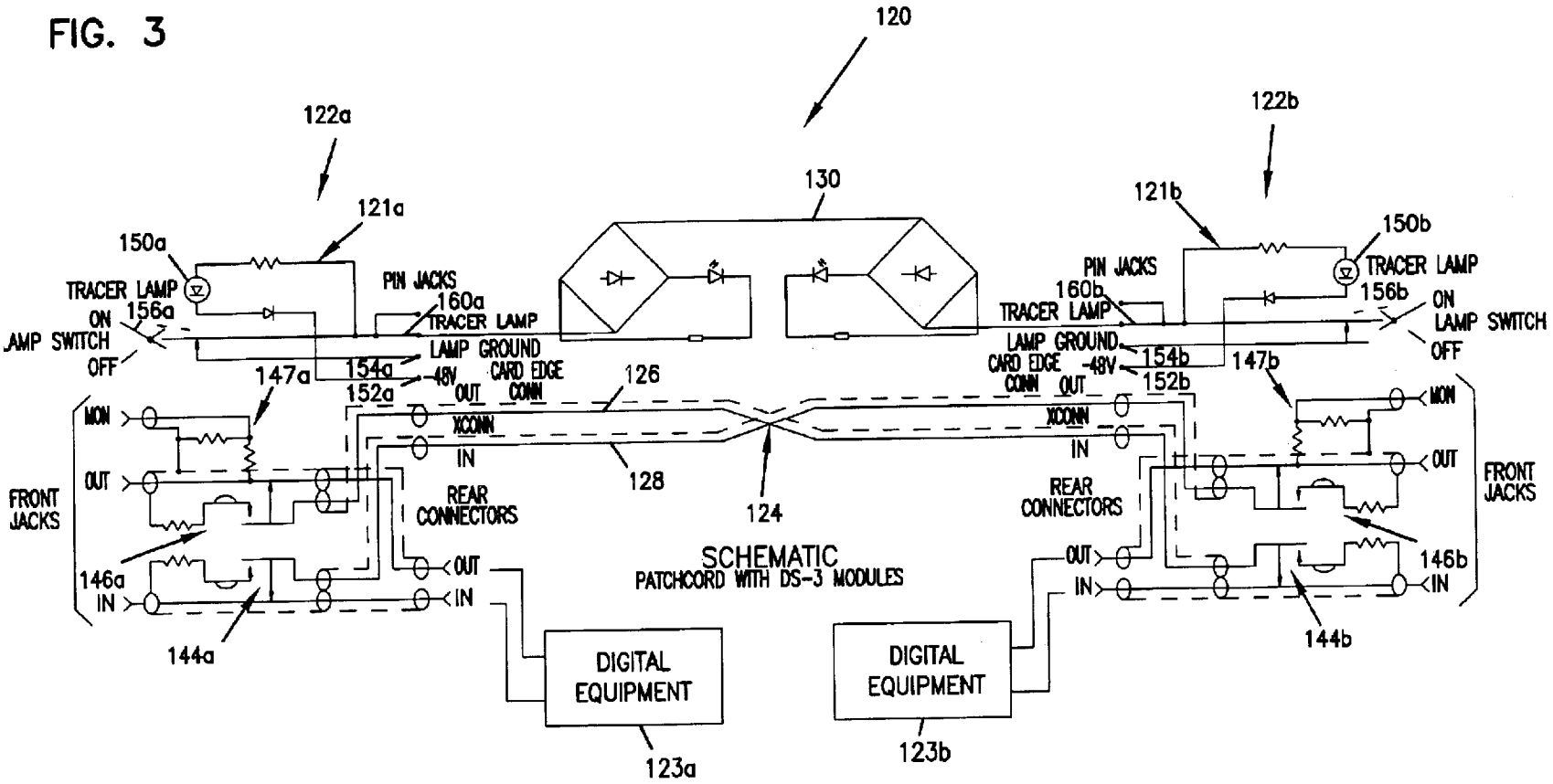
FIG. 3 is a schematic diagram of the DSX system of FIG. 2.

Referring to FIGS. 2 and 3, the DSX modules 122*a*, 122*b* include IN switching jacks 144*a*, 144*b* and OUT switching jacks 146*a*, 146*b* that provide a means for temporarily breaking the cross-connections between the pieces of telecommunications equipment 123*a*, 123*b* to allow access to the IN and OUT signals for test and patching operations. As is conventionally known in the art, the switching jacks include ports for receiving plugs used to access the IN and OUT signals. The switching jacks also include switches for temporarily breaking the cross-connections when the plugs are inserted within the ports for test and patching operations. In a preferred embodiment, the switches can be make-before-break switches. The DSX modules also include monitor networks 147*a*, 147*b* (shown in FIG. 3) for allowing signals to be non-intrusively monitored. Example switching jacks are also disclosed in U.S. Pat. Nos. 4,749,968 and 5,913,701, which are hereby incorporated by reference in their entireties.

Figure 4:
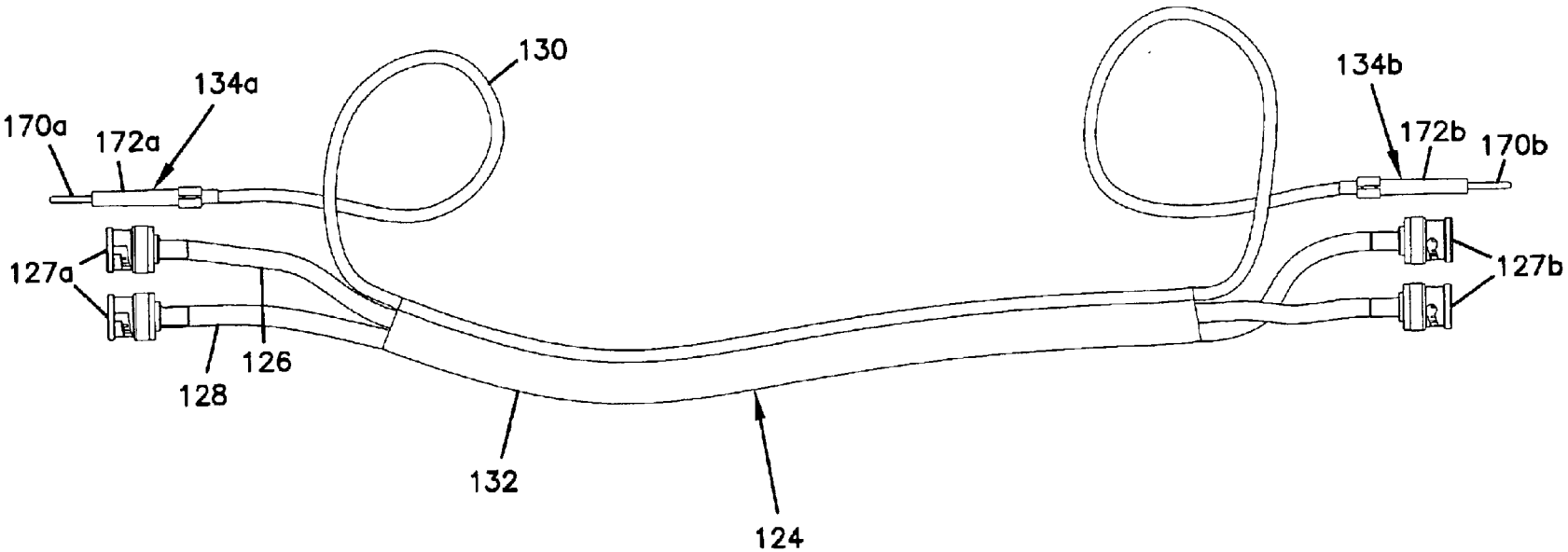
FIG. 4 shows the jumper assembly of FIG. 2 in isolation from the remainder of the DSX system.

Referring to FIGS. 2 and 4, the jumper assembly 124 of the cross-connect system 120 includes two jumper cables 126 and 128 (i.e., cross-connect cables) and a messenger wire 130. As used herein, the term "messenger wire" includes any elongate electrically conductive member. In one embodiment, the messenger wire is a copper wire. The jumper cables 126, 128 and the messenger wire 130 are bundled together by a sheath 132 to form the jumper assembly 124. Alternatively, the messenger wire 130 can be secured to the cables 126, 128 by any number of different techniques such as tying, binding, strapping, etc. In other embodiments, the messenger wire 130 can be separate/separable from the jumper cables 126, 128. The tracer lamp assemblies 134*a*, 134*b* are carried with the messenger wire 130. For example, in one embodiment, the tracer lamp assemblies 134*a*, 134*b* are mounted at opposite ends of the messenger wire 130. In other embodiments, lamp assemblies can be mounted at other locations along the length of the wire 130.

The jumper cables 126, 128 of the jumper assembly 124 are electrically coupled to rear ends of the modules 122*a*, 122*b* by connecters such as conventional coaxial connectors 127*a*, 127*b* (e.g., Bayonet Normalized Connectors (BNC), Threaded Normalized Connectors (TNC), 1.6/5.6 style connects, etc.). Similar connectors can be used to connect the cables 125*a*, 125*b* to the rear ends of the modules 122*a*, 122*b*.

As shown in FIG. 3, the modules 122*a*, 122*b* include tracer lamp circuits 121*a*, 121*b*. The tracer lamp circuits 121*a*, 121*b* include tracer lamps (e.g., the front LED's 150*a*, 150*b*). The LED's 150*a*, 150*b* are wired to power source contacts 152*a*, 152*b* and to ground contacts 154*a*, 154*b*. Switches 156*a*, 156*b* are positioned between the LED's 150*a*, 150*b* and their corresponding ground contacts 154*a*, 154*b*. The switches 156*a*, 156*b* allow the LED's 150*a*, 150*b* to be selectively connected to and disconnected from their corresponding ground contacts 154*a*, 154*b*.

The messenger wire 130 of the jumper assembly 124 electrically connects the tracer lamp circuits 121*a*, 121*b* together. In the depicted embodiment, pin jacks 160*a*, 160*b* provide connection locations for electrically connecting the messenger wire 130 to the tracer lamp circuits 121*a*, 121*b*. The pin jacks 160*a*, 160*b* include sockets for receiving conductive pins 170*a*, 170*b* (best shown in FIG. 4) coupled to the messenger wire 130. When either of the switches 156*a*, 156*b* is closed, the connection provided by the messenger wire 130 causes both the LED's 150*a*, 150*b* to be illuminated. For clarity, the wires connecting the switch 156*a*, the LED 150*a*, the power contact 152*a*, the ground contact 154*a* and the pin jack 160*a* are not shown in FIG. 2. The wires are schematically depicted in FIG. 3.

Figure 5:
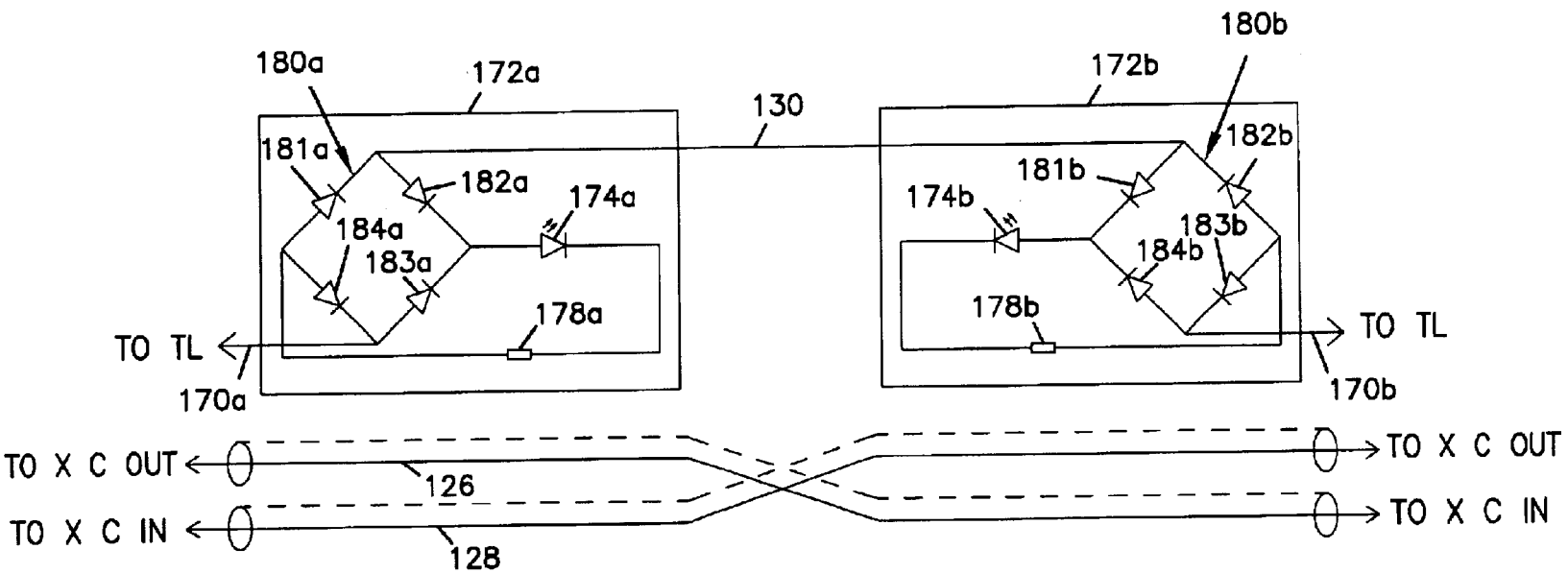
FIG. 5 is a schematic diagram of the jumper assembly of FIG. 4.

As indicated previously, the tracer lamp assemblies 134*a*, 134*b* are located at opposite ends of the messenger wire 130 (see FIG. 4). The assemblies include translucent housings 172*a*, 172*b* from which the conductive pins 170*a*, 170*b* project. The tracer lamp assemblies 134*a*, 134*b* also include structure for illuminating the housings 172*a*, 172*b*. For example, referring to FIG. 5, LED's 174*a*, 174*b* are mounted within each of the housings 172*a* 172*b*. The LED's 174*a*, 174*b* can include conventional flasher circuitry for causing the LED's 174*a*, 174*b* to flash for a predetermined length of time when activated and then turn to steady-on. In other embodiments, steady-on LED's can also be used without using flashing circuitry. The tracer lamp assemblies 134*a*, 134*b* also include resistors 178*a*, 178*b* positioned in series with the LED's 174*a*, 174*b*. Illumination devices (e.g., lamps) other than LED's could also be used.

It is well known that electrical current can only pass through a diode in one direction. In the drawings, this direction is indicated by the direction of the schematic diode arrows. Current flowing in a direction opposite to the diode arrows will be blocked from passing through the diodes. When current flows through a light emitting diode (LED), the LED is illuminated.

Figure 6:
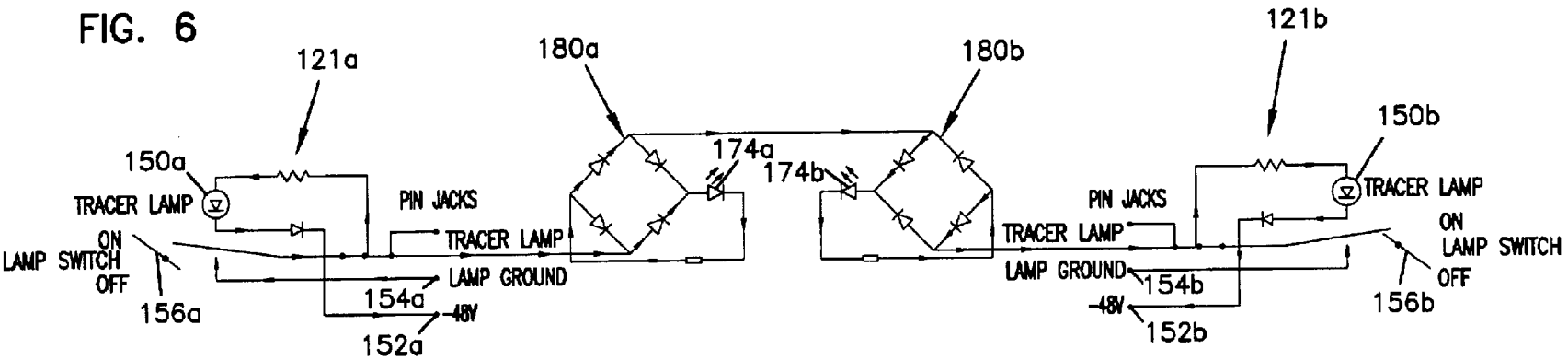
FIG. 6 is a schematic diagram illustrating current flow through the messenger wire of the jumper assembly when the switch of a left tracer lamp circuit is activated.
Figure 7:
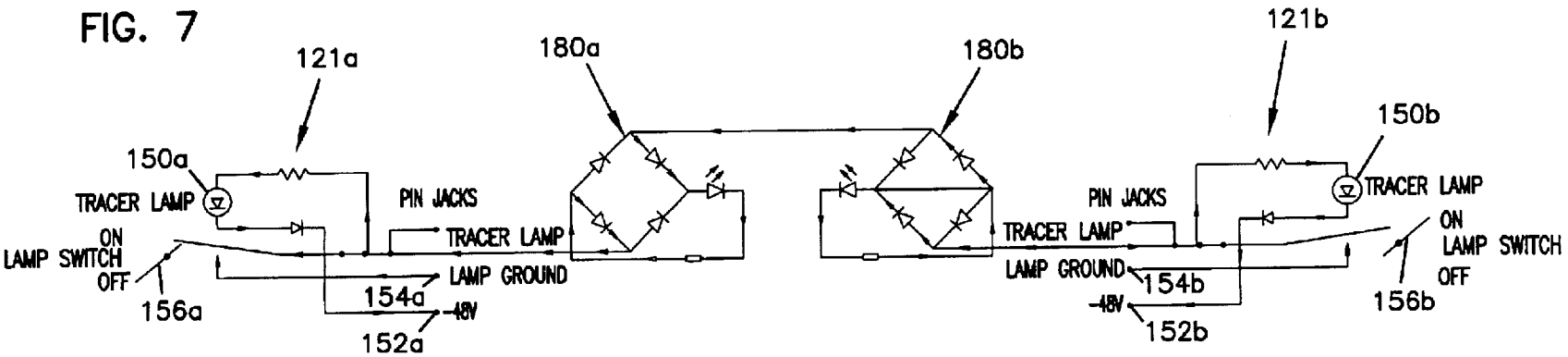
FIG. 7 is a schematic diagram illustrating current flow through the messenger wire of the jumper assembly when the switch of a right tracer lamp circuit is activated.

It is advantageous for the LED's 174*a*, 174*b* to illuminate regardless of the direction that current flows through the messenger wire 130. To ensure that current will flow to the LED's 174*a*, 174*b* in the direction of the LED diode arrows regardless of the direction that current flows through the messenger wire 130, the tracer lamp assemblies 134*a*, 134*b* include rectifier circuits 180*a*, 180*b* (see FIG. 5). The rectifier circuits 180*a*, 180*b* each include four diodes 181*a*–184*a* and 181*b*–184*b*. The rectifier circuits 180*a*, 180*b* route current flow so that it passes through the LED's 174*a*, 174*b* in the proper illumination direction regardless of whether the current is flowing through the messenger wire 130 from the tracer lamp circuit 121*a* to the tracer lamp circuit 121*b*, or from the tracer lamp circuit 121*b* to the tracer lamp circuit 121*a*. For example, when switch 156*a* is closed such that current flows through the messenger wire 130 from the tracer lamp circuit 121*a* to the tracer lamp circuit 121*b*, the rectifier circuits 180*a*, 180*b* cause both LED's 174*a*, 174*b* to be illuminated (see FIG. 6 where arrows have been added to show the direction of electrical current flow). Similarly, when switch 156*b* is closed such that current flows through the messenger wire 130 from the tracer lamp circuit 121*b* to the tracer lamp circuit 121*a*, the rectifier circuits 180*a*, 180*b* cause both LED's 174*a*, 174*b* to be illuminated (see FIG. 7 where arrows have been added to show the direction of electrical current flow). As is apparent from FIGS. 6 and 7, the LED's 150*a*, 150*b* as well as the LED's 174*a*, 174*b* illuminate whenever either of the switches 158*a*, 158*b* are closed.

Figure 8:
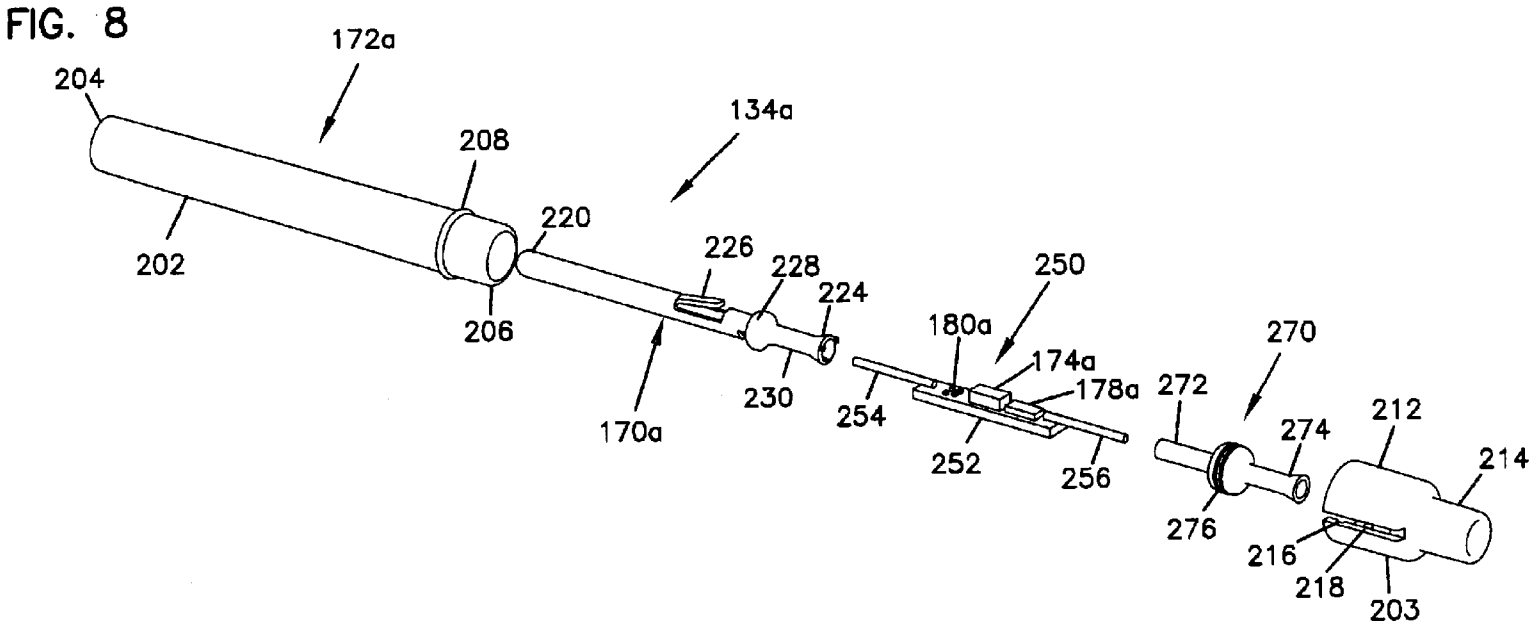
FIG. 8 is an exploded, perspective view of one of the tracer lamps that is integral with the messenger wire of the jumper assembly of FIGS. 4 and 5.

FIG. 8 is an exploded view of the tracer lamp assembly 134*a*. It will be appreciated that the tracer lamp assembly 134*b* has an identical configuration. Thus, only the tracer lamp assembly 134*a* will be described.

As shown in FIG. 8, the housing 172*a* of the tracer lamp assembly 134*a* has a two-piece configuration including a main housing piece 202 and a housing cap 203. The housing 172*a* is sized to hold a number of tracer lamp components such as the conductive pin 170*a*, a circuit board assembly 250, and a double-crimp conductor 270. The housing 172*a* is preferably made of a translucent material such as translucent plastic. In certain embodiments, the housing 172*a* can be transparent, opaque or tinted with a color (e.g., red, yellow, amber, blue, green, etc.).

The main housing piece 202 of the housing 172*a* has a hollow, cylindrical configuration and includes a first end 204 positioned opposite from a second end 206. An annular, outer retaining shoulder 208 is located adjacent the second end 206. An inner, annular retaining shoulder 210 (shown in FIG. 9) is located adjacent the first end 204.

Figure 9:
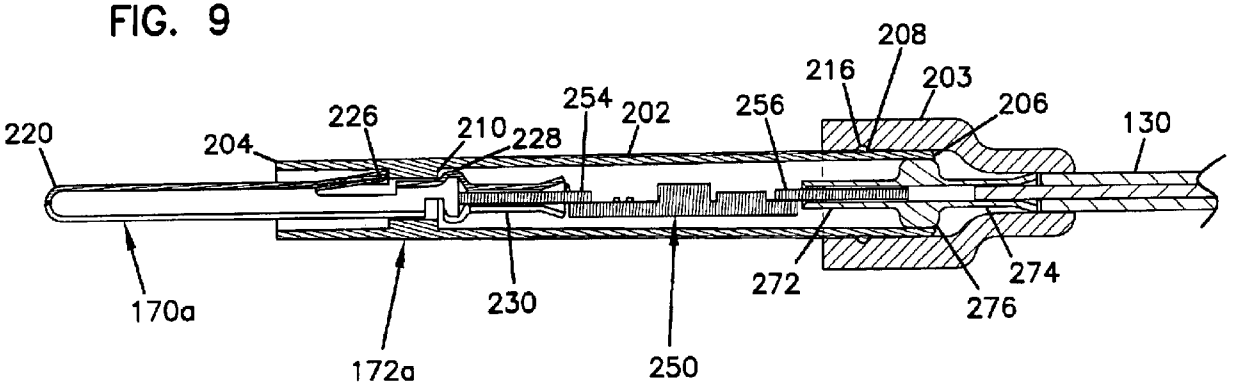
FIG. 9 is a cross-sectional view of the tracer lamp of FIG. 6 as assembled.

The housing cap 203 of the housing 172*a* includes an enlarged diameter portion 212 that necks down to a reduced diameter portion 214. As shown in FIGS. 8 and 9, the housing piece 203 is hollow and defines an inner, annular retaining recess 216. The enlarged diameter portion 212 includes one or more axial slots 218 for allowing the enlarged diameter portion 212 to elastically flex radially outwardly to snap fit over the second end 206 of the main housing piece 202.

As shown in FIGS. 8 and 9, the conductive pin 170*a* of the tracer lamp assembly 134*a* includes a first end 220 (i.e., a tip end) positioned opposite from a second end 224 (i.e., a base end). The conductive pin 170*a* also includes a resilient tab 226 spaced from a retaining shoulder 228. A crimping structure 230 is located at the second end 224 of the conductive pin 170*a*.

Referring to FIG. 8, the circuit board assembly 250 of the tracer lamp assembly 134*a* includes an elongate circuit board 252. The rectifier circuit 180*a*, the LED 174*a* and the resistor 178*a* are mounted on the circuit board 252. The circuit board 252 preferably includes tracings for electrically connecting the rectifier circuit 184*a*, the LED 174*a* and the resistor 178*a* in a manner consistent with the schematic shown in FIG. 5. The circuit board assembly 250 also includes conductive pins 254 and 256 that project outwardly from opposite ends of the elongate circuit board 252. It will be appreciated that tracings electrically connect the conductive pins 254 and 256 to the components on the circuit board 252.

Referring still to FIG. 8, the double-crimp conductor 270 of the tracer lamp assembly 134*a* includes a first crimping structure 272 positioned at an opposite end from a second crimping structure 274. An enlarged alignment structure 276 is positioned between the crimping structures 272, 274.

The tracer lamp assembly 134*a* is assembled by initially performing a sequence of crimping steps. For example, the first conductive pin 254 of the circuit board assembly 250 can be crimped within the crimping structure 230 of the pin 170*a*. Also, the second conductive pin 256 of the circuit board assembly 250 can be crimped within the crimping structure 272 of the double crimp conductor 270. Further, a stripped end of the messenger wire 130 can be inserted through the cap 203 of the housing 172*a* and crimped within the crimping structure 274 of the double crimped conductor 270.

After the components have been crimped together as described above, the entire crimped assembly is inserted through the second end 206 of the main housing piece 202. The assembly is pushed toward the first end 204 of the main housing piece 202 until the resilient tab 226 of the pin 170*a* snaps past the inner shoulder 210 of the housing piece 202 as shown in FIG. 9. With the resilient tab 226 snapped in place, the shoulder 210 is trapped between the resilient tab 226 and the retaining shoulder 228 of the conductive pin 170*a*. This limits axial movement of the conductive pin 170*a*relative to the housing 172*a*.

With the conductive pin 170*a* snapped in place as shown in FIG. 9, the first end 220 of the conductive pin 170*a* projects axially outwardly from the first end 204 of the main housing piece 202, and the circuit board assembly 250 is enclosed within an internal cavity of the main housing piece 202. Further, the alignment structure 276 of the double-crimp conductor 270 fits within the second end 206 of the main housing piece 202 to assist in aligning the crimping structures 272, 274 with a center axis of the housing 272*a*. The pin 127*a* also co-axially aligns with the housing 172*a*.

Once the conductive pin 170*a* has been snapped within the housing 172*a*, the cap 203 of the housing 172*a* is pushed over the second end 206 of the main housing piece 202. Preferably, the cap 203 is pushed onto the housing piece 202 until the retaining shoulder 208 of the main housing piece 202 snaps within the retaining recess 216 of the cap 203. Once this occurs, the pieces 202, 203 are interconnected by a snap-fit connection. However, it will be appreciated that other types of connections such as a press fit connection, a fastener type connection or an adhesive connection could also be used. FIG. 9 shows the shoulder 208 snapped within the retaining recess 216.

Figure 10:
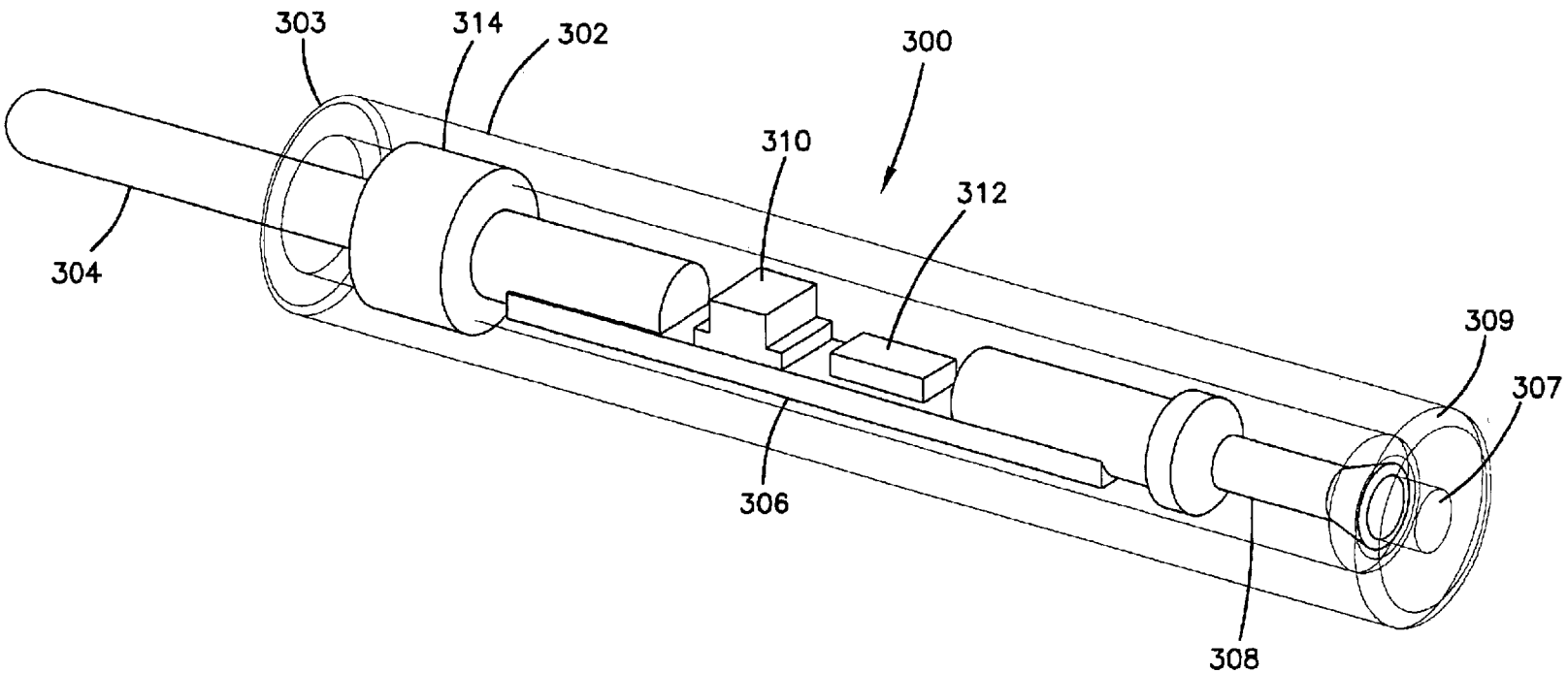
FIG. 10 illustrates an alternative tracer lamp configuration that is an example of how certain inventive concepts in accordance with the principles of the present disclosure can be practiced.

FIG. 10 shows an alternate tracer lamp assembly 300 that is an embodiment of certain inventive aspects in accordance with the principles of the present disclosure. The assembly 300 includes a translucent housing 302 having a hollow, cylindrical configuration. Tracer lamp circuitry is mounted within the housing. The tracer lamp circuitry includes a conductive pin 304, a circuit board 306, and a crimping structure 308. The conductive pin 304 and the conductive crimping structure 308 are connected to the circuit board 306 by a surface mount connection technique. An LED 310 and a resistor 312 are also surface mounted on the circuit board 306 by a surface mount connection technique. The conductive pin 304 includes a threaded portion 314 having external threads that thread within corresponding internal threads (not shown) within the housing 302 to hold the tracer lamp circuitry within the housing. To mount the tracer lamp circuitry within the housing, the tracer lamp circuitry is inserted through a first end 303 of the housing 302 and threaded into a locked position where the conductive pin 304 projects from the first end 303 of the housing 302 and the crimping structure 308 aligns with a clearance hole 307 defined at a second end 309 of the housing 302. In certain embodiments, the assembly 300 also includes a rectifier circuit. However, other configurations for routing current through the LED 310 in the proper illumination direction can also be used.

Figure 11:
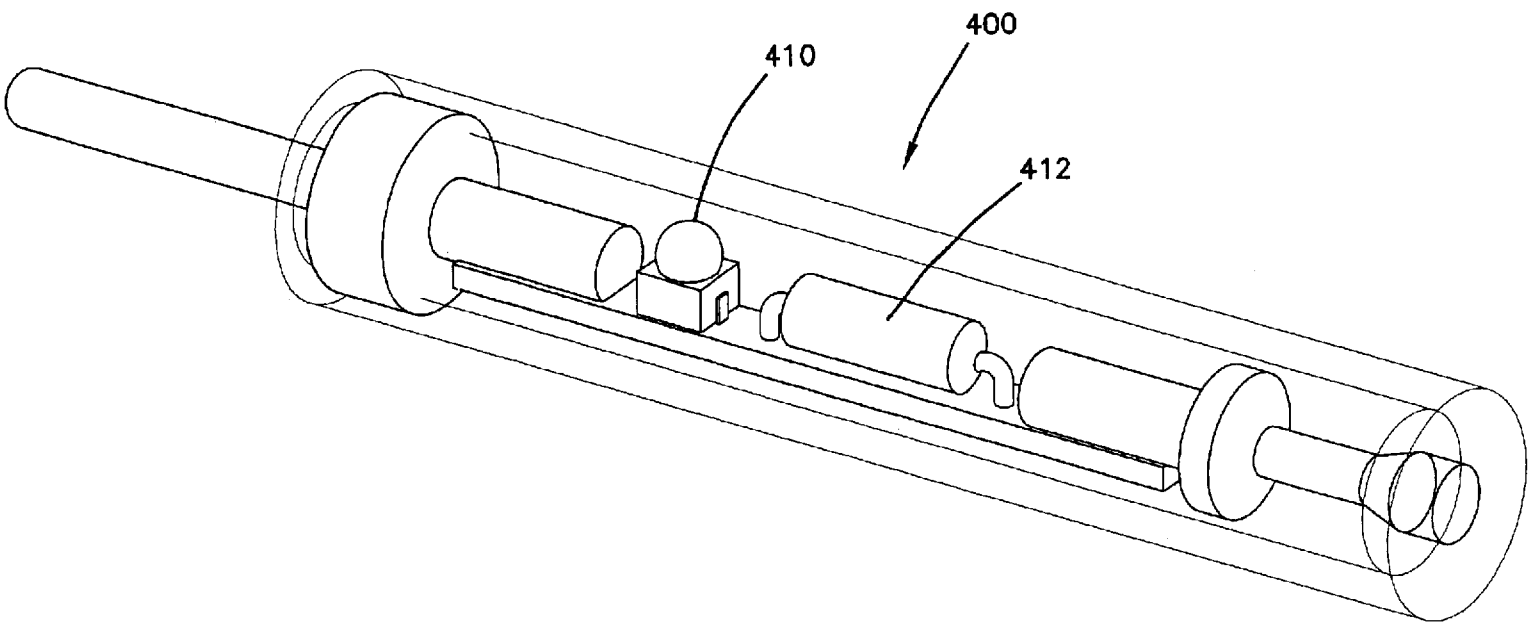
FIG. 11 illustrates another tracer lamp configuration that is an example of how certain inventive aspects in accordance with the principles of the present disclosure can be practiced.
Figure 12:
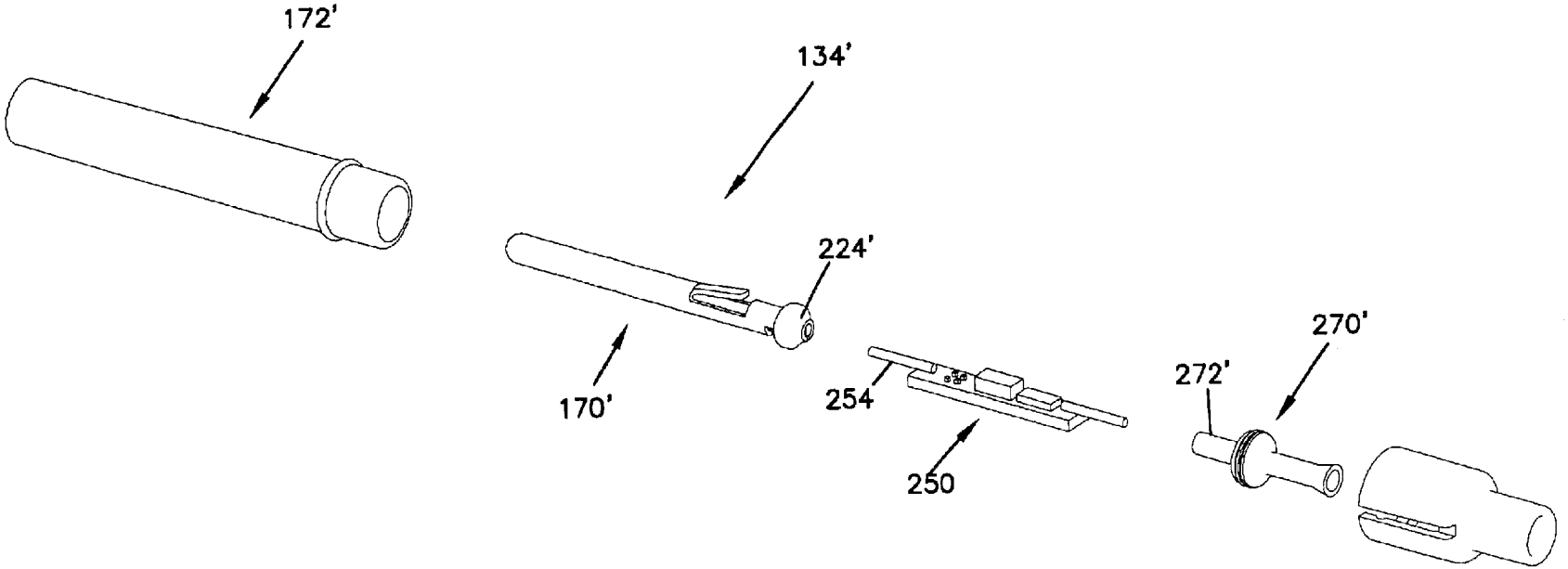
FIG. 12 illustrates a further tracer lamp configuration that is an example of how certain inventive aspects in accordance with the principles of the present disclosure can be practiced.

FIG. 11 illustrates another tracer lamp assembly 400 that is an embodiment of certain inventive aspects in accordance with the principles of the present disclosure. The assembly 400 has the same configuration as the assembly of FIG. 10 except a resistor 412 and an LED 410 are mounted to a circuit board by a through-hole connection technique (e.g., by soldering wires within plated through-holes of the circuit board) as compared to a surface mount connection technique (e.g., by mounting the components to conductive pads on the circuit board). The depicted embodiments of FIGS. 10 and 12 are used with unidirectional current through the messenger wire. Other embodiments can be bi-directional through the use of rectifier circuits as previously described or diodes arranged in parallel as described in the embodiment of FIG. 13.

FIG. 12 illustrates still another tracer lamp assembly 134' that is an embodiment of certain inventive aspects in accordance with the principles of the present disclosure. The assembly 134' has the same configuration as the assembly 134*a* of FIG. 8 except that modifications have been made to shorten the assembly to facilitate cable management. For example, a first crimping structure 272' of a double-crimp conductor 270' has been shortened as compared to the first crimping structure 272 of the double crimp conductor 270. Also, conductive pin 170' does not include a crimping structure. Instead, a second end 224' (i.e., a base end) of the pin 170' is soldered to the conductive pin 254 of the circuit board assembly 250. Further, a housing 172' of the assembly 134' has been shortened as compared to the housing 172 of the assembly 134*a*.

Figure 13:
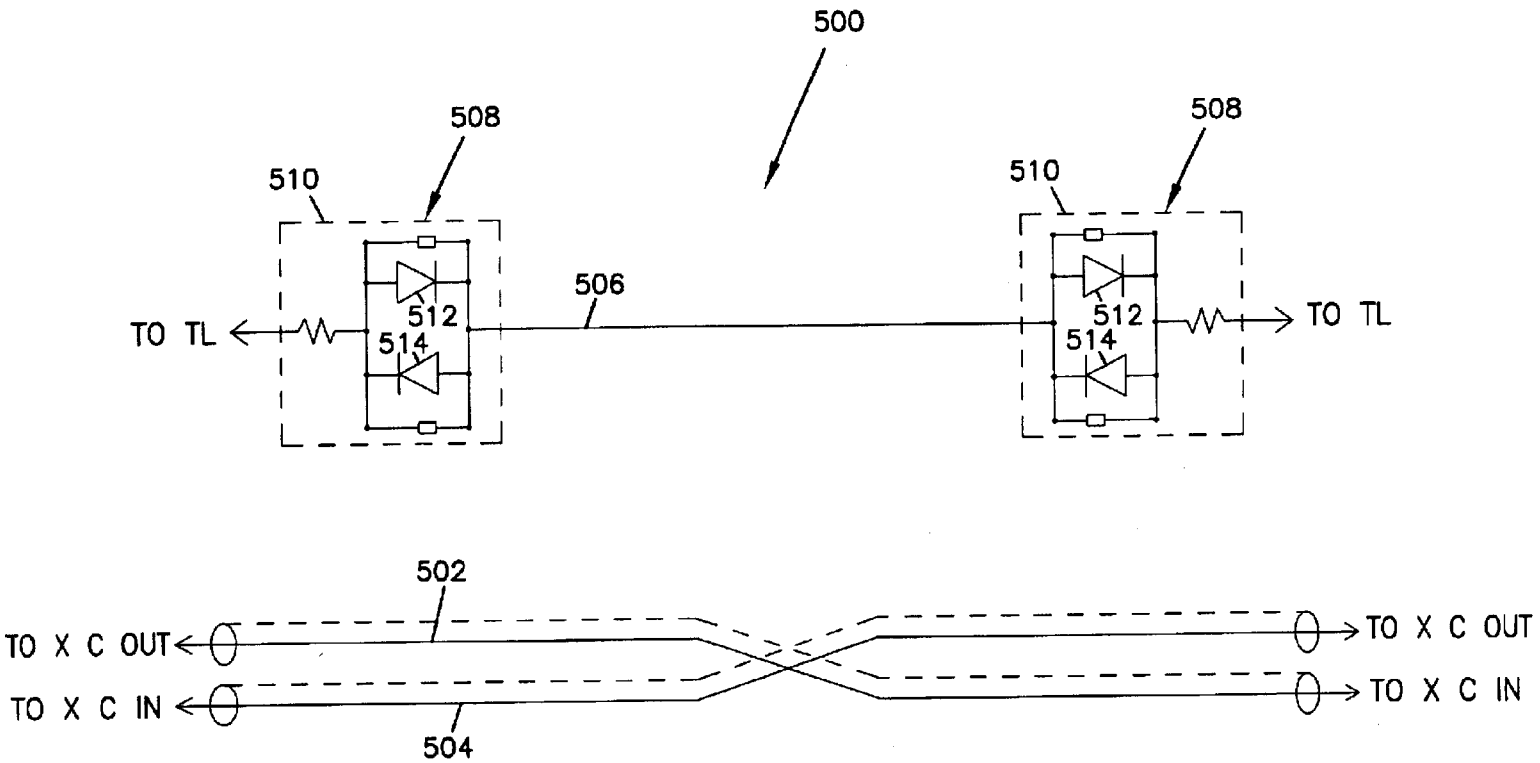
FIG. 13 is a schematic diagram of another jumper assembly configuration that is an example of how certain inventive aspects in accordance with the principles of the present disclosure can be practiced.

FIG. 13 is a schematic diagram of another jumper assembly 500 that is an example of how certain inventive aspects disclosed herein may be practiced. The jumper assembly 500 includes two jumper cables 502, 504 and a messenger wire 506. Light emitting diode structures 508 are carried with the messenger wire 506. Each light emitting diode structure 508 includes a housing 510 containing two light emitting diodes 512, 514. The light emitting diodes 512, 514 are aligned in parallel and have opposite current pass directions. This configuration ensures that the light emitting diode structures 508 will illuminate regardless of the direction of current flow through the messenger wire 506. For example, the diodes 514 will illuminate when current flows from right to left through the messenger wire 506, and the diodes 512 will illuminate when current flows from left to right through the messenger wire 506.

Figure 14:
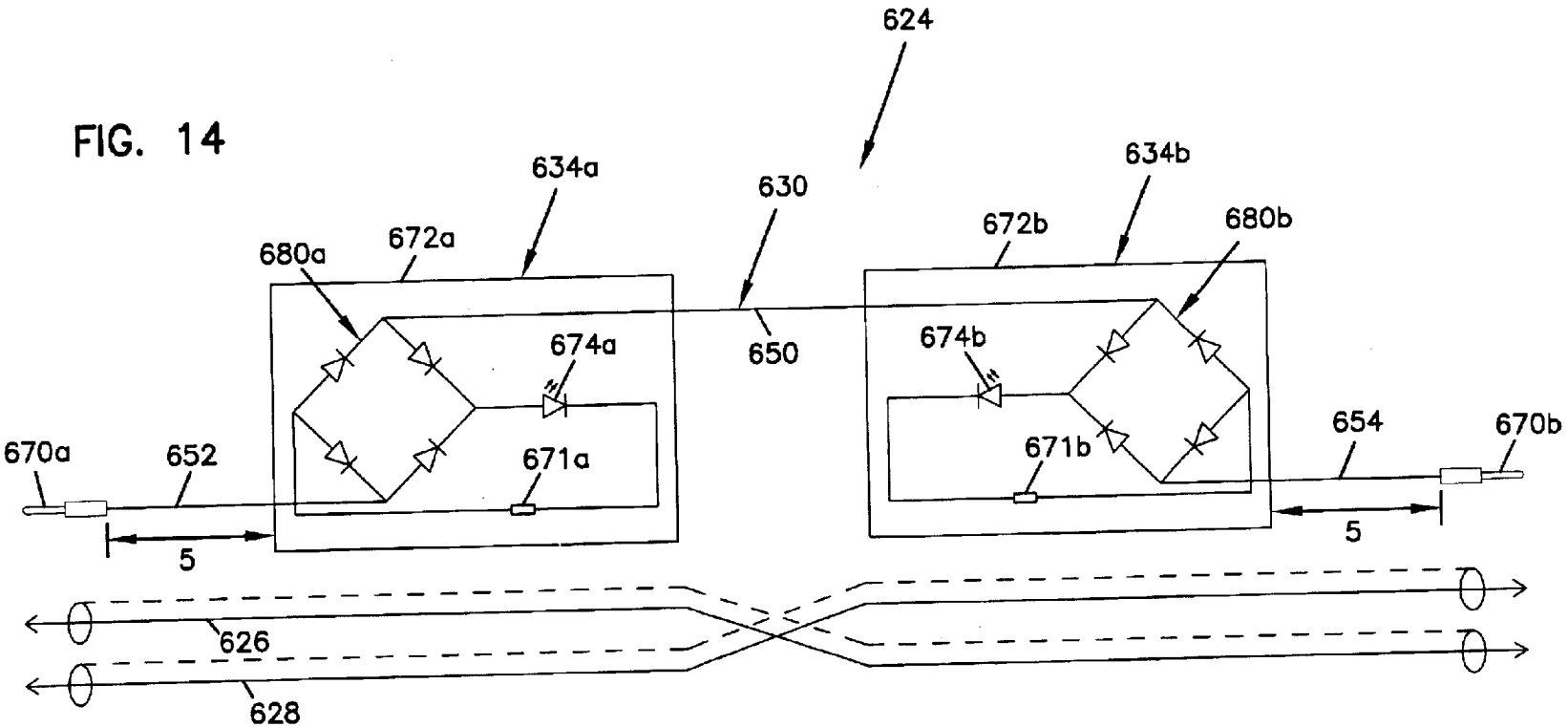
FIG. 14 is a schematic diagram of a further jumper assembly configuration that is an example of how certain inventive aspects in accordance with the principles of the present disclosure may be practiced.

FIG. 14 schematically shows an alternative jumper assembly 624 with an integral tracer lamp that is an embodiment of certain inventive aspects in accordance with the principles of the present disclosure. The jumper assembly 624 includes jumper cables 626 and 628 and a messenger wire 630 that is preferably secured to the jumper cables 626, 628. Tracer lamps 634*a*, 634*b* are carried with the messenger wire 630. The tracer lamps 634*a*, 634*b* are shown including translucent housings 672*a*, 672*b* containing LED's 674*a*, 674*b*, rectifier circuits 680*a*, 680*b* and resistors 671*a*, 671*b*. However, it will be appreciated that other types of lighting elements adapted to be illuminated by current traveling through the messenger wire 630 could also be used.

Referring still to FIG. 14, conductive pins 670*a*, 670*b* are mounted at opposite ends of the messenger wire 630. The pins 670*a*, 670*b* are adapted to be received within sockets of conventional pin jacks. The tracer light structures 634*a*, 634*b* are offset from the conductive pins 670*a*, 670*b*. For example, a spacing S separates each of the tracer lamp structures 634*a*, 634*b* from its respective conductive pin 670*a*, 670*b*. In one embodiment, the spacing is from 2–9 inches. In a more preferred embodiment, the spacing is from 3–6 inches.

The tracer lamp structures 634*a*, 634*b* are shown positioned in line with the messenger wire 630. For example, as shown in FIG. 14, the messenger wire 630 includes a first portion 650 that extends between the tracer lamp structures 634*a*, 634*b*, a second portion 652 that traverses the spacing between the conductive pin 670*a* and the tracer lamp structure 634*a*, and a third portion 654 that traverses the spacing between the conductive pin 670*b* and the tracer lamp structure 634*b*. The spacings provided by the portions 652, 654 of the messenger wire 630 assist in promoting cable management and also assist in allowing the tracer lamp structures 634*a*, 634*b* to be positioned at a location of increased visibility (e.g., offset a predetermined distance from a corresponding rack).

Figure 16:
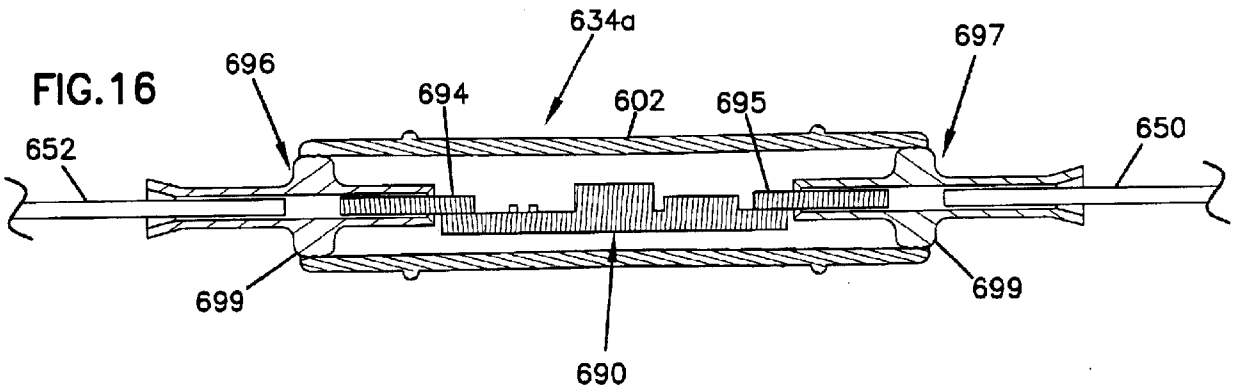
FIG. 16 is an assembled, cross-sectional view of the tracer lamp configuration of FIG. 15.
Figure 15:
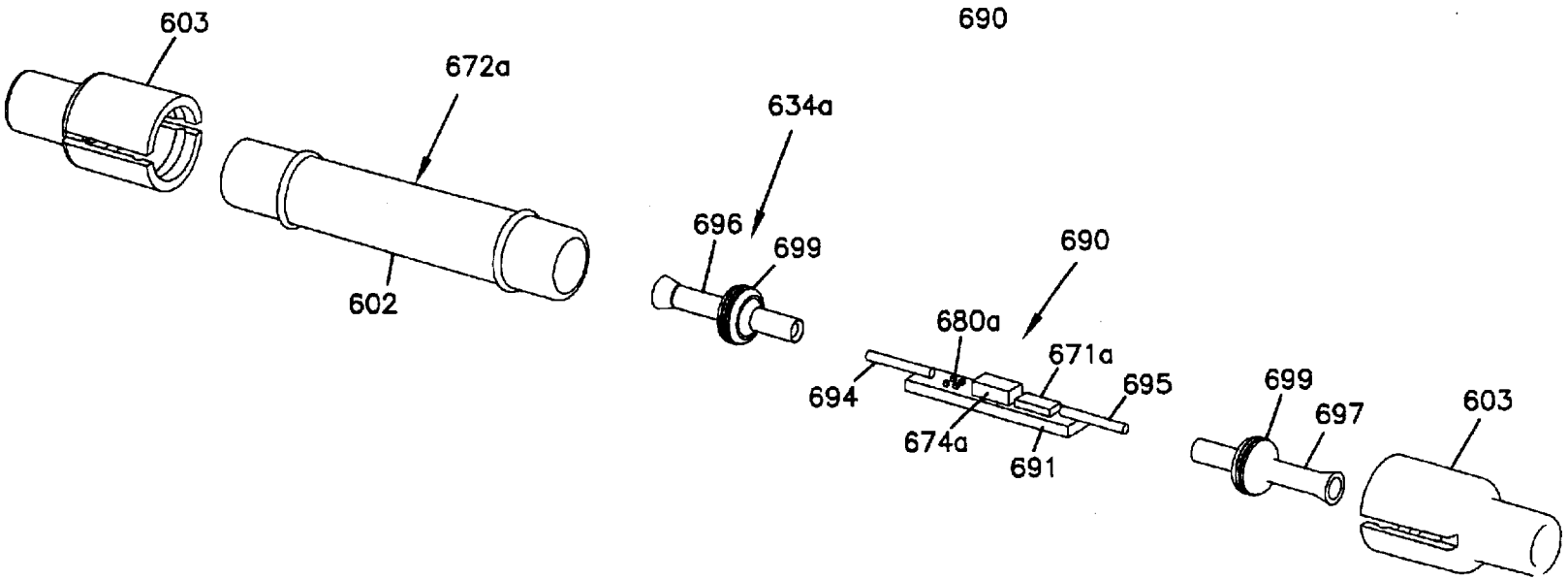
FIG. 15 is an exploded view of an example tracer lamp configuration adapted for use with the jumper assembly of FIG. 14.

FIGS. 15 and 16 illustrate an exemplary configuration for the tracer lamp structure 634*a*. It will be appreciated that the tracer lamp structure 634*b* can have the same configuration.

Referring to FIGS. 15 and 16, the translucent housing 672*a* of the tracer lamp structure 634*a* includes a middle portion 602 and two snap fit end caps 603. The end caps 603 are adapted to snap on the middle piece 602 in the same manner that the cap 203 of the housing 172*a* of FIG. 8 snaps onto the main housing piece 202.

Referring still to FIGS. 15 and 16, the tracer lamp structure 634*a* also includes a circuit board assembly 690 including a circuit board 691 on which the rectifier circuit 680*a*, the diode 674*a* and the resistor 671*a* are mounted. Tracings (not shown) can connect the circuit components in a manner consistent with the schematic of FIG. 14. Conductive pins 694 and 695 project outwardly from the circuit board 691. The conductive pins 694, 695 provide connection locations for coupling the components of the circuit board assembly 690 to double crimps 696, 697. FIG. 16 shows the crimps 696, 697 crimped upon the conductive pins 694, 695.

When fully assembled, the circuit board assembly 690 mounts within the housing 672*a*. The double crimps 696, 697 include centering members 699 for centering the circuit board assembly 690 within the housing 672*a*. The crimps 696, 697 provide means for coupling the first and second portions 650, 652 of the messenger wire 630 to the circuit board assembly 690. The end caps 603 have been omitted from FIG. 16 for clarity.

While example embodiments have been shown and described herein, it will be appreciated that many different embodiments of the inventions can be made without departing from the spirit and scope of the inventions. For example, each of the depicted embodiments shows tracer lamps positioned directly in-line with their corresponding messenger wires. In other embodiments, the tracer lamps can be indirectly coupled to their corresponding messenger wires by techniques such as an inductive coupling.

We claim:

1. A device for electrically connecting tracer lamp circuits corresponding to cross-connected DSX modules, the tracer lamp circuits of the DSX modules including pin jacks, the device comprising:

a messenger wire; and tracer lamp assemblies that illuminate when electrical current passes through the messenger wire, the tracer lamp assemblies including housings mounted at opposite ends of the messenger wire, the tracer lamp assemblies also including conductive pins that project from the housings, the conductive pins being adapted for insertion in the pin jacks of the tracer lamp circuits.

2. The device of claim 1, wherein the housings and the conductive pins are co-axially aligned.

3. The device of claim 1, wherein the housings are generally cylindrical.

4. The device of claim 1, wherein the housings are translucent and wherein the tracer lamp assemblies each include at least one light emitting diode mounted within each of the housings.

5. The device of claim 4, wherein the tracer lamp assemblies include circuit boards to which the light emitting diodes are mounted, the circuit boards being positioned within the housings.

6. The device of claim 5, wherein the circuit boards are elongated along an axis, wherein the circuit boards have opposite ends spaced-apart along the axes, and wherein the tracer lamp assemblies include conductive pins mounted to the circuit boards that project outwardly from the opposite ends.

7. The device of claim 1, wherein the tracer lamp assemblies each include light emitting diode structures, and wherein light emitting diode structures illuminate regardless of the direction that current passes through the messenger wire.

8. The device of claim 7, wherein the light emitting diode structures each include two light emitting diodes arranged in parallel with respect to one another.

9. The device of claim 1, wherein the conductive pins are snapped within the housings.

10. The device of claim 1, wherein the conductive pins are threaded within the housings.

11. The device of claim 1, wherein the housings each include two pieces interconnected together.

12. The device of claim 1, wherein the housings each include an elongated sleeve and a cap that connects to the sleeve.

13. A device for electrically connecting tracer lamp circuits corresponding to cross-connected DSX modules, the device comprising:

a messenger wire; and tracer lamp assemblies that illuminate when electrical current passes in a first direction through the messenger wire and that also illuminate when current passes in a apposite second direction through the messenger wire, the tracer lamp assemblies including translucent housings mounted to the messenger wire, the tracer lamp assemblies also including light omitting diodes positioned within the housings for illuminating the housings.

14. The device of claim 13, wherein the tracer lamp assemblies each include two light emitting diodes arranged in parallel.

15. The device of claim 13, further comprising circuit boards positioned within the translucent housings, the light emitting diodes being connected to the circuit boards.

16. A device for electrically connecting tracer lamp circuits corresponding to cross-connected DSX modules, the tracer lamp circuits of the DSX modules including pin jacks, the device comprising:

first and second cross-connect cables;

an electrically conductive member secured to the first and second cross-connect cables; and tracer lamp assemblies that illuminate when electrical current passes through the electrically conductive member, the tracer lamp assemblies including housings mounted at opposite ends of the electrically conductive member, the tracer lamp assemblies also including conductive pins that project from the housings, the conductive pins being adapted for insertion in the pin jacks of the tracer lamp circuits.

17. The device of claim 16, wherein the housings and the conductive pins are coaxially aligned.

18. The device of claim 16, wherein the housings are generally cylindrical.

19. The device of claim 16, wherein the housings are translucent, and wherein the tracer lamp assemblies each include at least one light emitting diode mounted within each of the housings.

20. The device of claim 19, wherein the tracer lamp assemblies include circuit boards to which the light emitting diodes are mounted, the circuit boards being positioned within the housings.

21. The device of claim 20, wherein the circuit boards are elongated along an axis, wherein the circuit boards have opposite ends spaced-apart along the axes, and wherein the tracer lamp assemblies include conductive pins mounted to the circuit boards that that project outwardly from the opposite ends.

22. The device of claim 16, wherein the tracer lamp assemblies each include light emitting diode structures, and wherein light emitting diode structures illuminate regardless of the direction that current passes through the messenger wire.

23. The device of claim 22, wherein the light emitting diode structures each include two light emitting diodes arranged in parallel with respect to one another.

24. The device of claim 16, wherein the conductive pins are snapped within the housings.

25. The device of claim 16, wherein the conductive pins are threaded within the housings.

26. The device of claim 16, wherein the housings each include two pieces interconnected together.

27. The device of claim 16, wherein the housings each include an elongated sleeve and a cap that connects to the sleeve.

28. The device of claim 16, wherein the cross-connect cables comprise co-axial cables having co-axial connectors mounted at opposite ends thereof.

29. The device of claim 16, wherein the electrically conductive member is secured to the cross-connect cables by a sheath.

30. A DSX system comprising:

first and second DSX devices cross-connected together by cross-connect cables, the DSX devices each including a front end and a rear end, the DSX devices also each including a tracer lamp circuit including a first tracer lamp and a switch for activating the first tracer lamp, the first tracer lamps being positioned at the front ends of the DSX devices;

a messenger wire that electrically connects the tracer lamp circuits of the DSX devices, the messenger wire having opposite ends connected to the rear ends of the DSX devices; and second tracer lamps mounted to the messenger wire, the second tracer lumps being visible from the rear ends of the DSX devices, and the second tracer lamps being activated by the switches of the tracer lamp circuits of the DSX devices.

31. The DSX system of claim 30, wherein the tracer lamp circuits include pin jacks located at the rear ends of the DSX devices, and wherein the messenger wire is electrically connected to the pin jacks by conductive pins inserted within the pin jacks.

32. The DSX system of claim 31, wherein the second tracer lamps include housings containing light emitting diodes, the housings being positioned between the messenger wire and tips of the conductive pins.

33. The DSX system of claim 32, wherein the conductive pins have base ends located within the housings, and wherein the tips of the conductive pins project outwardly from the housings.

34. The DSX system of claim 33, wherein the conductive pins are co-axially aligned with the housings.

* * * * *

UNITED STATES PATENT AND TRADEMARK OFFICE

CERTIFICATE OF CORRECTION

PATENT NO. : 6,743,044 B2
DATED : June 1, 2004
INVENTOR(S) : Musolf et al.

It is certified that error appears in the above-identified patent and that said Letters Patent is hereby corrected as shown below:

Column 9,
Line 47, “in a apposite” should read -- in an opposite --

Column 10,
Line 22, “boards that that project” should read -- boards that project --

Signed and Sealed this

Seventh Day of December, 2004

JON W. DUDAS
*Director of the United States Patent and Trademark Office*